US010352234B2

(12) United States Patent
Tobe

(10) Patent No.: US 10,352,234 B2
(45) Date of Patent: Jul. 16, 2019

(54) ENGINE CONTROL APPARATUS

(71) Applicant: SUBARU CORPORATION, Tokyo (JP)

(72) Inventor: Shota Tobe, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 34 days.

(21) Appl. No.: 15/835,240

(22) Filed: Dec. 7, 2017

(65) Prior Publication Data

US 2018/0245536 A1 Aug. 30, 2018

(30) Foreign Application Priority Data

Feb. 28, 2017 (JP) ..... 2017-037249

(51) Int. Cl.
*F02D 41/30* (2006.01)
*F02B 77/04* (2006.01)
(Continued)

(52) U.S. Cl.
CPC ..... *F02B 77/04* (2013.01); *F02D 41/047* (2013.01); *F02D 41/3094* (2013.01);
(Continued)

(58) Field of Classification Search
CPC .. F02D 41/047; F02B 77/04; F02B 2077/045; F02M 26/50
See application file for complete search history.

(56) References Cited

U.S. PATENT DOCUMENTS 5,634,449 A * 6/1997 Matsumoto ..... F02D 41/047 123/478
5,765,533 A * 6/1998 Nakajima ..... F02D 41/0087 123/492
(Continued)

FOREIGN PATENT DOCUMENTS

JP 2008-014179 A 1/2008
JP 2009-228531 A 10/2009
(Continued)

OTHER PUBLICATIONS

Japanese Office Action, dated Jul. 31, 2018, in Japanese Application No. 2017-037249 and English Translation thereof.
(Continued)

*Primary Examiner* — Sizo B Vilakazi
*Assistant Examiner* — Kevin R Steckbauer
(74) *Attorney, Agent, or Firm* — McGinn IP Law Group, PLLC.

(57) ABSTRACT

An engine control apparatus controls includes a cleaning mode to clean a deposit generated in an intake system of an engine. The engine control apparatus includes a generation source calculator, a deposit calculator, and a mode controller. The generation source calculator is configured to calculate an attached generation source amount on the basis of a temperature of the intake system. The attached generation source amount is an amount of a generation source, of the deposit, attached to the intake system. The deposit calculator is configured to calculate an attached deposit amount that is an amount of the deposit attached to the intake system, on the basis of the attached generation source amount and the temperature of the intake system. The mode controller is configured to execute the cleaning mode, when the attached deposit amount is greater than an execution threshold.

3 Claims, 7 Drawing Sheets

(51) Int. Cl.
*F02M 35/10* (2006.01)
*F02M 26/50* (2016.01)
*F02D 41/04* (2006.01)

(52) U.S. Cl.
CPC ..... *F02M 26/50* (2016.02); *F02M 35/1038* (2013.01); *F02M 35/10216* (2013.01); *F02B 2077/045* (2013.01); *F02D 2200/04* (2013.01); *F02D 2250/00* (2013.01); *F02M 2200/05* (2013.01)

(56) References Cited

U.S. PATENT DOCUMENTS 6,508,234 B2 * 1/2003 Machida ..... F02D 41/047 123/478
6,799,560 B2 * 10/2004 Kojima ..... F02B 31/06 123/491
9,664,130 B2 * 5/2017 Wilcutts ..... F02D 41/0087
2002/0170541 A1 * 11/2002 Machida ..... F02D 41/047 123/478
2004/0079342 A1 * 4/2004 Kojima ..... F02B 31/06 123/491
2013/0060452 A1 * 3/2013 Saruwatari ..... F02D 41/32 701/105
2014/0278007 A1 * 9/2014 Wilcutts ..... F02D 41/0087 701/104
2014/0326225 A1 * 11/2014 Shioda ..... F02C 6/12 123/559.1
2016/0377007 A9 * 12/2016 Wilcutts ..... F02D 41/0087 701/104

FOREIGN PATENT DOCUMENTS

JP 2009228531 A * 10/2009 ..... F02D 41/3094
JP 2013-053598 A 3/2013
JP 2016-151247 A 8/2016

OTHER PUBLICATIONS

JPO Decision to Grant a Patent dated Nov. 6, 2018 with English translation.

* cited by examiner

ENGINE CONTROL APPARATUS

CROSS-REFERENCE TO RELATED APPLICATIONS

The present application claims priority from Japanese Patent Application No. 2017-037249 filed on Feb. 28, 2017, the entire contents of which are hereby incorporated by reference.

BACKGROUND

The technology relates to an engine control apparatus that cleans a deposit of an intake system.

A deposit derived from carbonization of a substance such as fuel and engine oil may be accumulated on a component such as an intake port of an engine and an intake valve of the engine. The great quantity of accumulation of the deposit on the component such as the intake port may influence an operation state of the engine. Therefore, it is desired to remove the deposit by a cleaning fluid. For example, Japanese Unexamined Patent Application Publication No. 2013-53598 discloses a control apparatus that estimates an amount of the accumulated deposit, and executes a deposit cleaning mode in accordance with the estimated amount of the accumulated deposit. The estimation of the amount of the accumulated deposit is performed on the basis of a factor such as a gas amount of a mixture of fuel and air flowing back toward the intake port, and a temperature of the mixture of the fuel and the air flowing back toward the intake port.

SUMMARY

A process of generation of a deposit involves a stage at which a generation source of the deposit is attached to a component such as an intake port and an intake valve, and a stage at which the attached generation source is carbonized or oxidized and thereby turn into the deposit. The generation source of the deposit may be, for example but not limited to, fuel, engine oil, or any other substance. In order to improve accuracy in estimation of an amount of the accumulated deposit, it has been necessary to take into consideration situations in each of the stages. The situations, in each of the stages, to be taken into consideration may include, for example but not limited to, a situation of attachment of the generation source, and a situation of generation of the deposit. In other words, it is desired to achieve execution of a cleaning mode at appropriate timing by improving the accuracy in estimation of the amount of the accumulated deposit, while taking into consideration the situations, in each of the stages, such as the situation of the attachment of the generation source and the situation of the generation of the deposit.

It is desirable to provide an engine control apparatus that is able to execute a cleaning mode at appropriate timing.

An aspect of the technology provides an engine control apparatus that includes a cleaning mode. The cleaning mode cleans a deposit generated in an intake system of the engine. The engine control apparatus includes a generation source calculator, a deposit calculator, and a mode controller. The generation source calculator is configured to perform calculation of an attached generation source amount on the basis of a temperature of the intake system. The attached generation source amount is an amount of a generation source, of the deposit, attached to the intake system. The deposit calculator is configured to perform calculation of an attached deposit amount on the basis of the attached generation source amount and the temperature of the intake system. The attached deposit amount is an amount of the deposit attached to the intake system. The mode controller is configured to execute the cleaning mode, when the attached deposit amount is greater than an execution threshold.

An aspect of the technology provides an engine control apparatus that includes a cleaning mode. The cleaning mode cleans a deposit generated in an intake system of an engine. The engine control apparatus includes circuitry. The circuitry is configured to perform calculation of an attached generation source amount on the basis of a temperature of the intake system. The attached generation source amount is an amount of a generation source, of the deposit, attached to the intake system. The circuitry is configured to perform calculation of an attached deposit amount on the basis of the attached generation source amount and the temperature of the intake system. The attached deposit amount is an amount of the deposit attached to the intake system. The circuitry is configured to execute the cleaning mode, when the attached deposit amount is greater than an execution threshold.

DETAILED DESCRIPTION

In the following, some non-limiting implementations of the technology are described in detail with reference to the accompanying drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example implementations which are not recited in a most-generic independent claim of the disclosure are optional and may be provided on an as-needed basis. The drawings are schematic and are not intended to be drawn to scale.

Figure 1:
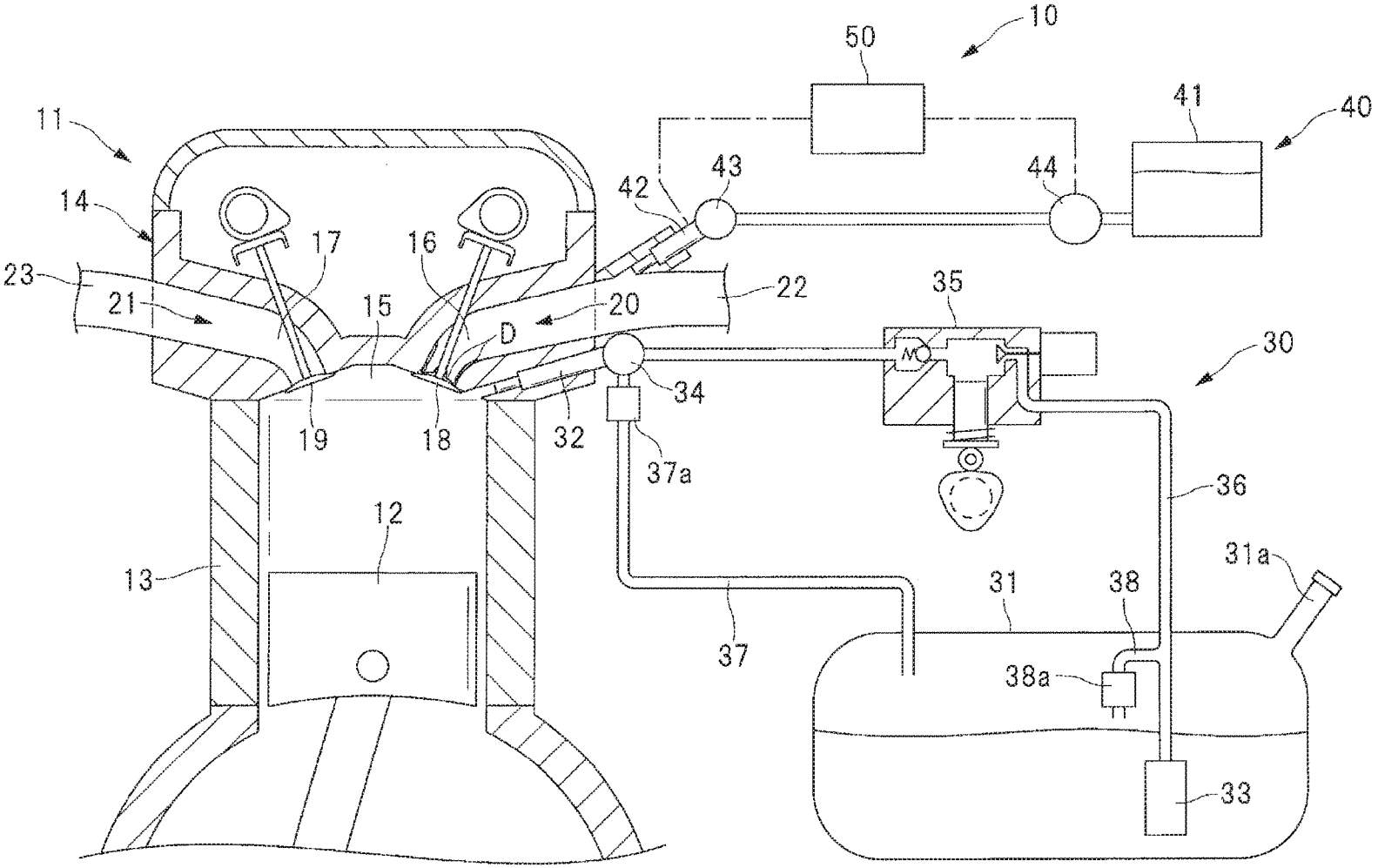
FIG. 1 illustrates an example of an outline of an engine to which an engine control apparatus according to one implementation of the technology is applied.

FIG. 1 illustrates an example of an outline of an engine 11 to which an engine control apparatus 10 according to one implementation of the technology is applied. Referring to FIG. 1, the engine 11 may include a cylinder block 13 and a cylinder head 14 mounted on the cylinder block 13. The cylinder block 13 may contain a piston 12. The cylinder head 14 may be provided with an intake port 16 and an exhaust port 17 that are both in communication with a combustion chamber 15. The cylinder head 14 may be also provided with an intake valve 18 and an exhaust valve 19. The intake valve 18 may cause the intake port 16 to be open or closed. The exhaust valve 19 may cause the exhaust port 17 to be open or closed. In such a manner, an intake system 20 of the engine 11 may be provided with the intake port 16 and the intake valve 18, while an exhaust system 21 of the engine 11 may be provided with the exhaust port 17 and the exhaust valve 19. Further, the intake port 16 of the cylinder head 14 may be coupled to an intake tube 22. The exhaust port 17 of the cylinder head 14 may be coupled to an exhaust tube 23.

The engine 11 may further include a fuel system 30 that supplies fuel to the combustion chamber 15. The fuel system 30 may include a fuel tank 31 and a fuel injector 32. The fuel tank 31 may pool the fuel such as gasoline. The fuel injector 32 may inject the fuel into the combustion chamber 15. The fuel system 30 may further include a low-pressure pump 33 and a high-pressure pump 35. The low-pressure pump 33 may be provided inside the fuel tank 31. The high-pressure pump 35 may be coupled to a delivery pipe 34 of the fuel injector 32. The low-pressure pump 33 and the high-pressure pump 35 may be coupled to each other with a fuel duct 36 in between. The fuel in the fuel tank 31 may be supplied to the fuel injector 32 via the low-pressure pump 33 and the high-pressure pump 35. As described above, the engine 11 illustrated by way of example in FIG. 1 may be a direct-injection engine in which the fuel is injected into the combustion chamber 15. It is to be noted that the delivery pipe 34 may be coupled to a returning duct 37 provided with a regulator valve 37*a*. Further, the fuel duct 36 may be coupled to a branched duct 38 provided with a regulator valve 38*a*.

The engine 11 may further include a cleaning system 40 that supplies a cleaning fluid to the intake system 20, in order to remove a deposit D attached to the intake system 20. The cleaning system 40 may include a cleaning fluid tank 41, a cleaning injector, and a supplying pump 44. The cleaning fluid tank 41 may pool the cleaning fluid directed to removing of the deposit D. The cleaning injector 42 may inject the cleaning fluid into the intake port 16. The supplying pump 44 may be coupled to a delivery pipe 43 of the cleaning injector 42. The cleaning fluid pooled in the cleaning fluid tank 41 may be supplied to the cleaning injector 42 from the cleaning fluid tank 41 via the supplying pump 44. The cleaning fluid supplied to the cleaning injector 42 may be injected from the cleaning injector 42 into the intake port 16. Such injection of the cleaning fluid into the intake port 16 may cause the cleaning fluid to be applied to the components, of the intake system 20, such as the intake port 16 and the intake valve 18. It is thereby possible to allow the cleaning fluid to permeate the deposit D attached to the components of the intake system 20, and thereby remove the deposit D attached to the components of the intake system 20. The cleaning fluid may include, for example but not limited to, a cleaning agent such as polyisobutene amine (PIBA), polyether amine (PEA), a surfactant, diethyl glycol, monobutyl ether, polyoxyethylene, and nonylphenyl ether. The surfactant may be, for example but not limited to, an anionic surfactant, a cationic surfactant, an amphoteric surfactant, or a non-ionic surfactant.

Referring to FIG. 1, the deposit D attached to the intake system 20 may be derived from oils and fats that are carbonized or oxidized, and thereby accumulated on a place such as an inner surface of the intake port 16 and a surface of the intake valve 18. Non-limiting example of the oils and fats may include the fuel and engine oil. Hereinafter, the oils and fats may be referred to by the term "oil-fat" for the sake of simple description. A situation of the accumulation of the deposit D may vary in accordance with a factor such as an amount of the attached oil-fat that is a generation source of the deposit D, and a temperature of the intake port 16 or any other component. Accordingly, the engine control apparatus 10 may have a function of estimating an amount of the accumulated deposit D on the basis of an operation situation of the engine 11, and controlling the cleaning system 40 on the basis of the estimated amount of the accumulated deposit D, which will be described later in greater detail.

Figure 2:
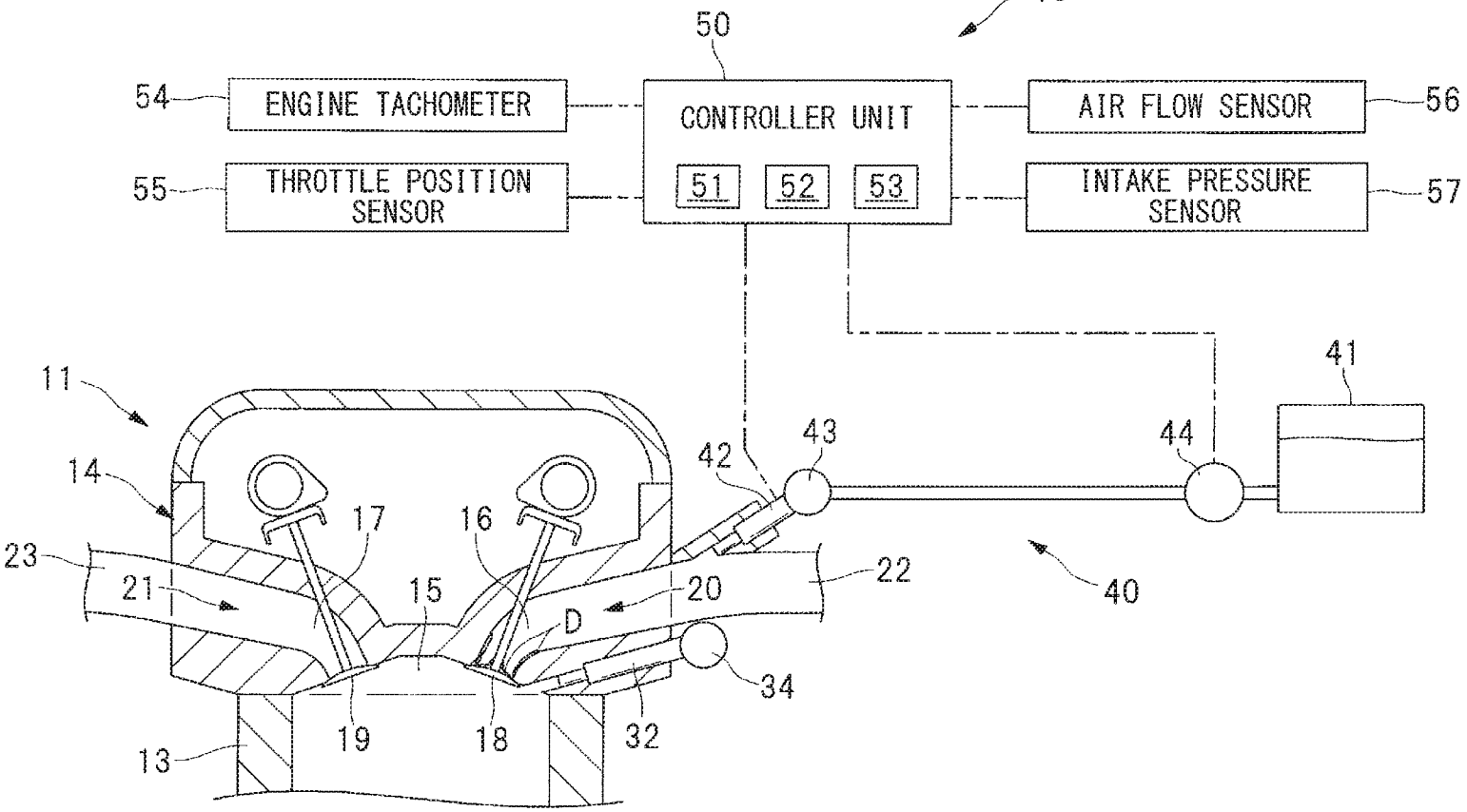
FIG. 2 illustrates an outline of an example of a configuration of the engine control apparatus.

FIG. 2 illustrates an outline of an example of a configuration of the engine control apparatus 10. Referring to FIG. 2, the engine control apparatus 10 may include a controller unit 50 directed to controlling of the components, of the cleaning system 40, such as the supplying pump 44 and the cleaning injector 42. The controller unit 50 may be configured by, for example but not limited to, a microcomputer. The controller unit 50 may include functional units such as a generation source calculator 51, a deposit calculator 52, and a mode controller 53. The generation source calculator 51 may calculate an amount of the oil-fat attached to the intake system 20. The deposit calculator 52 may calculate an amount of the deposit D accumulated on or attached to the intake system 20. The mode controller 53 may execute the cleaning mode that performs the injection of the cleaning fluid. Further, the controller unit 50 may be coupled to various sensors. Non-limiting examples of the various sensors may include an engine tachometer 54, a throttle position sensor 55, an air flow sensor 56, and an intake pressure sensor 57. The engine tachometer 54 may detect revolutions of the engine 11 that is a revolution speed of an unillustrated crank shaft. The throttle position sensor 55 may detect a throttle position of an unillustrated throttle valve. The air flow sensor 56 may detect an amount of intake air flowing through the intake tube 22. The intake pressure sensor 57 may detect an intake air pressure inside the intake tube 22.

[Situation of Increase and Decrease in Oil-fat and In Deposit]

Figure 3:
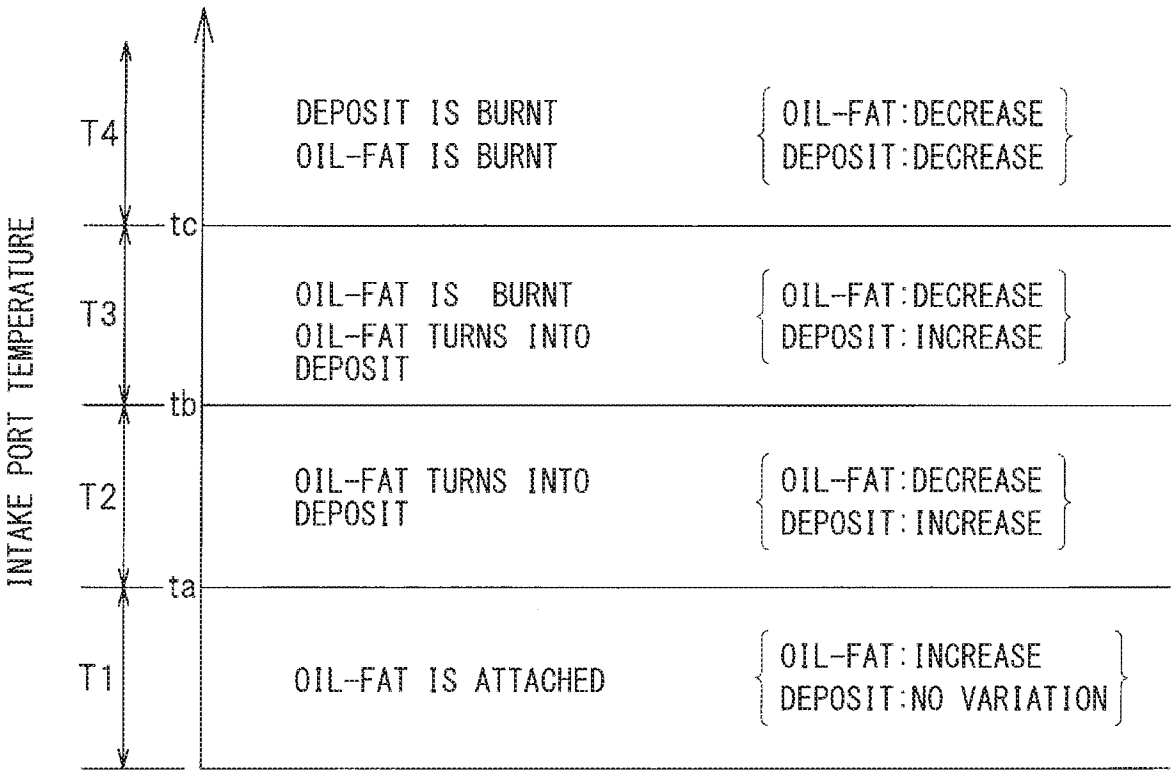
FIG. 3 describes a situation of an increase and a decrease in oil-fat, and also describes a situation of an increase and a decrease in a deposit.

A description is given next of a relationship between a temperature of the intake port 16 and a situation of an increase and a decrease both in the oil-fat and in the deposit D on the intake system 20. The temperature of the intake port 16 may serve as a temperature of the intake system 20, and will be hereinafter referred to as an intake port temperature Tp. FIG. 3 describes the situation of the increase and the decrease in the oil-fat, and also describes the situation of the increase and the decrease in the deposit D.

Referring to FIG. 3, when the intake port temperature Tp is lower than a temperature threshold ta, i.e., when the intake port temperature Tp falls within a temperature range T1, the oil-fat is less likely to turn into the deposit D. Therefore, the amount of the oil-fat attached to the intake system 20 increases. In other words, when the intake port temperature Tp falls within the temperature range T1, the oil-fat is not reduced by turning into the deposit D or by being burnt. Therefore, the amount of the oil-fat attached to the intake system 20 increases in accordance with the elapse of time. It is to be noted that, when the intake port temperature Tp falls within the temperature range T1, the oil-fat is less likely to turn into the deposit D. Therefore, the amount of the deposit D accumulated on the intake system 20 is kept constant without increasing or decreasing.

When the intake port temperature Tp is equal to or higher than the temperature threshold ta and is lower than a temperature threshold tb, i.e., when the intake port temperature Tp falls within a temperature range T2, the oil-fat turns into the deposit D. Therefore, the amount of the oil-fat attached to the intake system 20 decreases while the amount of the deposit D accumulated on the intake system 20 increases, in accordance with the elapse of time. When the intake port temperature Tp is equal to or higher than the temperature threshold tb and is lower than a temperature threshold tc, i.e., when the intake port temperature Tp falls within a temperature range T3, the oil-fat is burnt or turns into the deposit D. Therefore, the amount of the oil-fat attached to the intake system 20 decreases while the amount of the deposit D accumulated on the intake system 20 increases, in accordance with the elapse of time. When the intake port temperature Tp is equal to or higher than the temperature threshold tc, i.e., when the intake port temperature Tp falls within a temperature range T4, the oil-fat and the deposit D are both burnt. Therefore, the amount of the oil-fat attached to the intake system 20 decreases while the amount of the deposit D accumulated on the intake system 20 also decreases, in accordance with the elapse of time.

When the intake port temperature Tp falls within any of the temperature ranges in which the oil-fat is reduced, a speed at which the oil-fat turns into the deposit D or a speed at which the oil-fat is burnt is higher as the intake port temperature Tp is higher. Therefore, the amount of the attached oil-fat decreases by a greater amount as the intake port temperature Tp is higher. For example, the amount of the attached oil-fat decreases by a greater amount in a case where the intake port temperature Tp falls within the temperature range T4, than in a case where the intake port temperature Tp falls within the temperature range T3. Further, the amount of the attached oil-fat decreases by a greater amount in the case where the intake port temperature Tp falls within the temperature range T3, than in a case where the intake port temperature Tp falls within the temperature range T2.

When the intake port temperature Tp falls within any of the temperature ranges in which the deposit D increases, a speed at which the oil-fat turns into the deposit D is higher as the intake port temperature Tp is higher. Therefore, the amount of the accumulated deposit D increases by a greater amount as the intake port temperature Tp is higher. For example, the amount of the accumulated deposit D increases by a greater amount in the case where the intake port temperature Tp falls within the temperature range T3, than in the case where the intake port temperature Tp falls within the temperature range T2.

As described above, when the intake port temperature Tp falls within a temperature range that is lower than the temperature threshold ta, the amount of the oil-fat attached to the intake system 20 increases. In contrast, when the intake port temperature Tp falls within a temperature range that is equal to or higher than the temperature threshold ta, the amount of the oil-fat attached to the intake system 20 decreases. In other words, when the temperature of the intake system 20 is relatively low, the amount of the attached oil-fat that is the generation source of the deposit D increases. In contrast, when the temperature of the intake system 20 is relatively high, the amount of the attached oil-fat that is the generation source of the deposit D decreases. In one implementation, the temperature threshold ta may serve as a "first temperature threshold".

Further, when the intake port temperature Tp falls within a temperature range that is equal to or higher than the temperature threshold ta and is lower than the temperature threshold tc, the amount of the deposit D accumulated on the intake system 20 increases. The temperature threshold tc is higher than the temperature threshold ta. In contrast, when the intake port temperature Tp falls within a temperature range that is equal to or higher than the temperature threshold tc, the amount of the deposit D accumulated on the intake system 20 decreases. In other words, when the temperature of the intake system 20 is relatively low, the amount of the accumulated deposit D increases. In contrast, when the temperature of the intake system 20 is relatively high, the amount of the accumulated deposit D decreases. It is to be noted that, when the intake port temperature Tp falls within the temperature range that is lower than the temperature threshold ta, the amount of the deposit D accumulated on the intake system 20 is kept constant without increasing or decreasing. In one implementation, the temperature threshold tc may serve as a "second temperature threshold".

[Flowchart]

Figure 4:
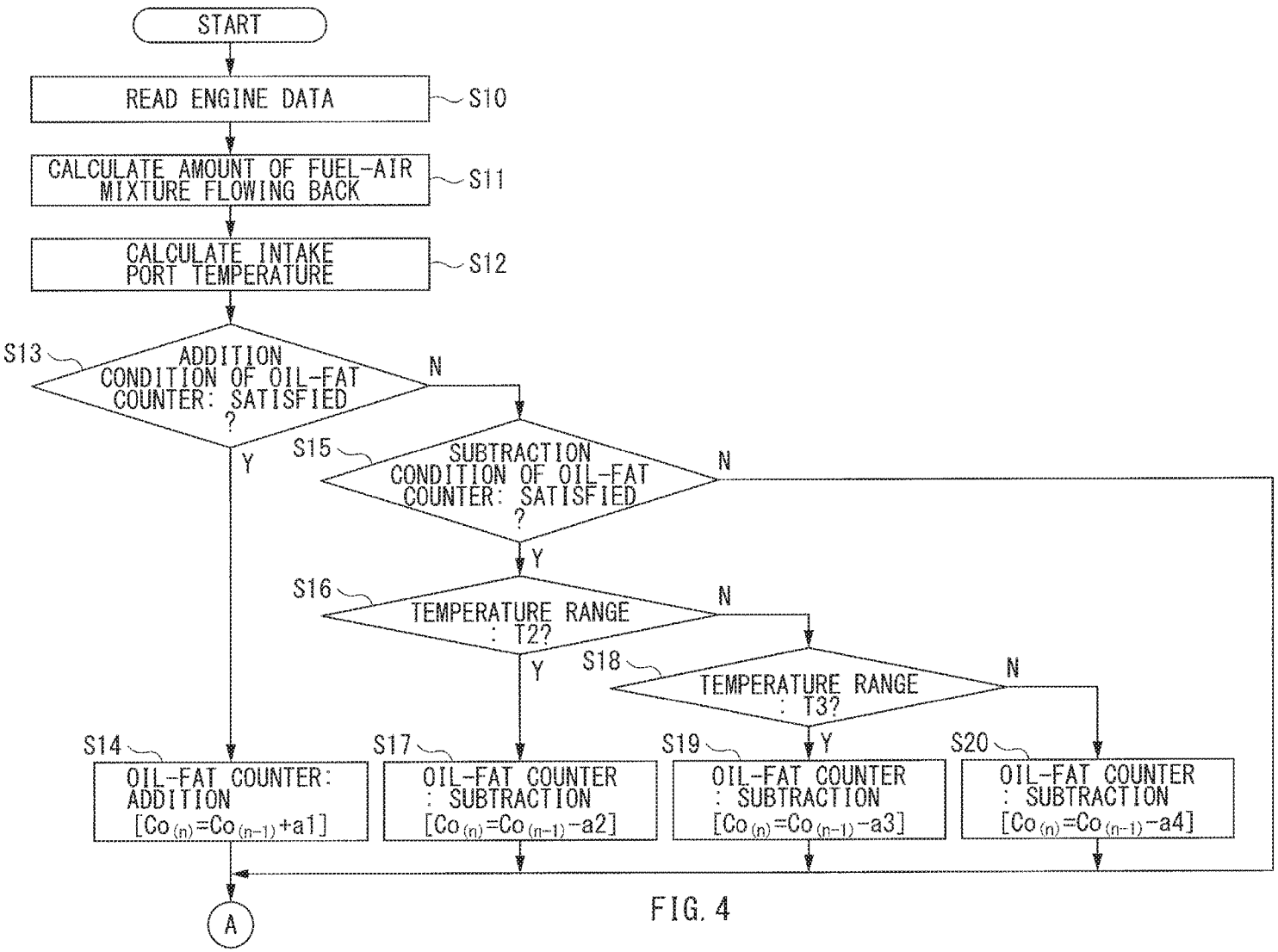
FIG. 4 is a flowchart illustrating an example of a procedure for executing a cleaning mode.
Figure 5:
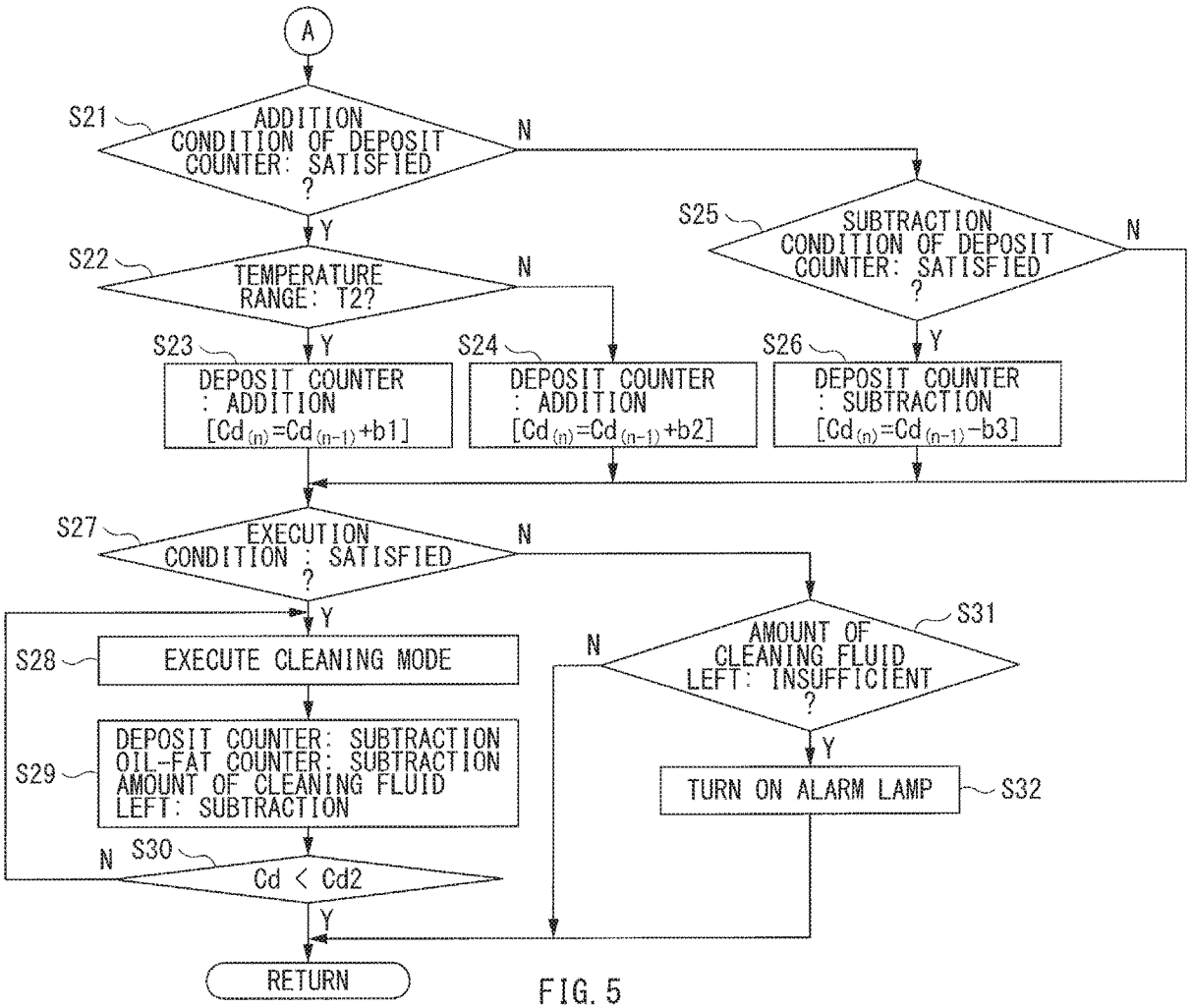
FIG. 5 is a flowchart illustrating an example of the procedure for executing the cleaning mode.

A description is given next of a procedure for executing the cleaning mode by the controller unit 50 with reference to a flowchart. FIGS. 4 and 5 each illustrate a flowchart of an example of the procedure for executing the cleaning mode. The flowcharts illustrated in respective FIGS. 4 and 5 are connected to each other at a point denoted with the symbol "A".

Referring to FIG. 4, in step S10, engine data may be read. The engine data may include, for example but not limited to, the engine revolutions, the throttle position, the intake air amount, and the intake air pressure. In step S11, the amount of fuel-air mixture may be calculated on the basis of the engine revolutions, a load on the engine 11, and any other suitable factor. The fuel-air mixture may refer to mixture of the fuel and the air that flows back from the combustion chamber 15 to the intake port 16. Further, in step S12, the intake port temperature Tp may be calculated on the basis of the engine revolutions, the load on the engine 11, and any other suitable factor. It is to be noted that the load on the engine 11 may be calculated on the basis of the throttle position, the intake air amount, the intake air pressure, and any other suitable factor.

[Increase and Decrease in Oil-fat Counter]

In step S13, a determination may be made as to whether an addition condition of an oil-fat counter Co is satisfied. The oil-fat counter Co may be a counter that indicates the amount of the attached oil-fat that is the generation source of the deposit D. The great value of the oil-fat counter Co may indicate that the amount of the oil-fat attached to the intake system 20 is great. The small value of the oil-fat counter Co may indicate that the amount of the oil-fat attached to the intake system 20 is small.

Non-limiting examples of the case in which the addition condition of the oil-fat counter Co is satisfied in step S13 may include a case where: the value of the oil-fat counter Co is equal to or smaller than a predetermined upper limit value Co1; the amount of the fuel-air mixture flowing back is equal to or greater than a predetermined value; and a situation in which the intake port temperature Tp falls within the temperature range T1 is continuously kept for a predetermined period of time. Further, when a determination is made in step S13 that the addition condition of the oil-fat counter Co is satisfied, the flow may proceed to step S14. In step S14, a predetermined value a1 may be added to the latest value of the oil-fat counter $Co_{(n-1)}$, and the oil-fat counter Co may be updated thereby. After the oil-fat counter Co is updated in step S14, the flow may proceed to step S21 illustrated in FIG. 15 which will be described later.

In contrast, when a determination is made in step S13 that the addition condition of the oil-fat counter Co is not satisfied, the flow may proceed to step S15. In step S15, a determination may be made as to whether a subtraction condition of the oil-fat counter Co is satisfied. Non-limiting examples of the case in which the subtraction condition of the oil-fat counter Co is satisfied in step S15 may include a case where: the value of the oil-fat counter Co is greater than 0 (zero); and a situation in which the intake port temperature Tp falls within any of the temperature ranges T2, T3, and T4 is continuously kept for a predetermined period of time.

When the determination is made in step S15 that the subtraction condition of the oil-fat counter Co is satisfied, the flow may proceed to step S16. In step S16, a determination may be made as to whether the intake port temperature Tp falls within the temperature range T2. In contrast, when a determination is made in step S15 that the subtraction condition of the oil-fat counter Co is not satisfied, the flow may proceed to step S21. When a determination is made in step S16 that the intake port temperature Tp falls within the temperature range T2, the flow may proceed to step S17. In step S17, a predetermined value a2 may be subtracted from the latest value of the oil-fat counter $Co_{(n-1)}$, and the oil-fat counter Co may be updated thereby. After the oil-fat counter Co is updated in step S17, the flow may proceed to step S21.

When a determination is made in step S16 that the intake port temperature Tp does not fall within the temperature range T2, the flow may proceed to step S18. In step S18, a determination may be made as to whether the intake port temperature Tp falls within the temperature range T3. When a determination is made in step S18 that the intake port temperature Tp falls within the temperature range T3, the flow may proceed to step S19. In step S19, a predetermined value a3 may be subtracted from the latest value of the oil-fat counter $Co_{(n-1)}$, and the oil-fat counter Co may be updated thereby. After the oil-fat counter Co is updated in step S19, the flow may proceed to step S21.

When a determination is made in step S18 that the intake port temperature Tp does not fall within the temperature range T3, i.e., when a determination is made that the intake port temperature Tp falls within the temperature range T4, the flow may proceed to step S20. In step S20, a predetermined value a4 may be subtracted from the latest value of the oil-fat counter $Co_{(n-1)}$, and the oil-fat counter Co may be updated thereby. After the oil-fat counter Co is updated in step S20, the flow may proceed to step S21.

It is to be noted that, in the subtraction process performed on the oil-fat counter Co, a greater value may be subtracted from the value of the oil-fat counter Co as the intake port temperature Tp falls within a higher one of the temperature ranges T2 to T4. For example, the predetermined value a3 used in the subtraction process in step S19 may be greater than the predetermined value a2 used in the subtraction process in step S17. Further, the predetermined value a4 used in the subtraction process in step S20 may be greater than the predetermined value a3 used in the subtraction process in step S19.

[Increase and Decrease in Deposit Counter]

As described above, when the oil-fat counter Co is updated in any of steps S14, S17, S19, and S20, or when the determination is made in step S15 that the subtraction condition of the oil-fat counter Co is not satisfied, a deposit counter Cd may be updated thereafter. Referring to FIG. 5, in subsequent step S21, a determination may be made as to whether an addition condition of the deposit counter Cd is satisfied. The deposit counter Cd may refer to a counter that indicates the amount of the deposit D accumulated on the intake system 20. The great value of the deposit counter Cd may indicate that the amount of the deposit D accumulated on the intake system 20 is great. The small value of the deposit counter Cd may indicate that the amount of the deposit D accumulated on the intake system 20 is small.

Non-limiting examples of a case where the addition condition of the deposit counter Cd is satisfied in step S21 may include a case where: the value of the oil-fat counter Co is equal to or greater than a predetermined addition threshold Co2; and a situation in which the intake port temperature Tp falls within any of the temperature ranges T2 and T3 is continuously kept for a predetermined period of time. Further, when a determination is made in step S21 that the addition condition of the deposit counter Cd is satisfied, the flow may proceed to step S22. In step S22, a determination may be made as to whether the intake port temperature Tp falls within the temperature range T2.

When a determination is made in step S22 that the intake port temperature Tp falls within the temperature range T2, the flow may proceed to step S23. In step S23, a predetermined value b1 may be added to the latest value of the deposit counter $Cd_{(n-1)}$, and the deposit counter Cd may be updated thereby. In contrast, when a determination is made in step S22 that the intake port temperature Tp does not fall within the temperature range T2, i.e., when a determination is made that the intake port temperature Tp falls within the temperature range T3, the flow may proceed to step S24. In step S24, a predetermined value b2 may be added to the latest value of the deposit counter $Cd_{(n-1)}$, and the deposit counter Cd may be updated thereby.

It is to be noted that, in the addition process performed on the deposit counter Cd, a greater value may be added to the value of the deposit counter Cd as the intake port temperature Tp falls within a higher one of the temperature ranges T2 and T3. For example, the predetermined value b2 used in the addition process in step S24 may be greater than the predetermined value b1 used in the addition process in step S23.

In contrast, when a determination is made in step S21 that the addition condition of the deposit counter Cd is not satisfied, the flow may proceed to step S25. In step S25, a determination may be made as to whether a subtraction condition of the deposit counter Cd is satisfied. Non-limiting example of a case where the subtraction condition of the deposit counter Cd is satisfied in step S25 may include a case where: the value of the deposit counter Cd is greater than 0 (zero); and a situation in which the intake port temperature Tp falls within the temperature range T4 is continuously kept for a predetermined period of time. Further, when a determination is made in step S25 that the subtraction condition of the deposit counter Cd is satisfied, the flow may proceed to step S26. In step S26, a predetermined value b3 may be subtracted from the latest value of the deposit counter $Cd_{(n-1)}$, and the deposit counter Cd may be updated thereby. In contrast, when a determination is made in step S25 that the subtraction condition of the deposit counter Cd is not satisfied, the flow may proceed to step S27. After the deposit counter Cd is updated in any of steps S23, S24, and S26, the flow may also proceed to step S27.

[Execution of Cleaning Mode]

In step S27, a determination may be made, on the basis of the deposit counter Cd or any other information, as to whether an execution condition of the cleaning mode is satisfied. Non-limiting examples of a case where the execution condition of the cleaning mode is satisfied in step S27 may include a case where: the value of the deposit counter Cd is greater than a predetermined execution threshold Cd1; the intake air pressure is a negative pressure; warm-up of the engine 11 is completed; and an amount of the cleaning fluid left in the cleaning fluid tank 41 is greater than a defined amount. It is to be noted that the injection of the cleaning fluid into the intake port 16 may cause, for example but not limited to, a decrease in output of the engine 11. Therefore, in terms of ensuring a stable operation state of the engine 11, the two conditions, i.e., the condition that the intake air pressure is the negative pressure and the condition that the warm-up of the engine 11 is completed may be set as conditions for permitting the execution of the cleaning mode.

When a determination is made in step S27 that the execution condition of the cleaning mode is satisfied, the flow may proceed to step S28. In step S28, the cleaning mode may be executed that causes the cleaning injector 42 to inject the cleaning fluid. When the cleaning mode is executed in such a manner, the deposit D and the oil-fat may be removed by the cleaning fluid. Thereafter, the flow may proceed to step S29. In step S29, a predetermined value may be subtracted from the latest value of the deposit counter $Cd_{(n-1)}$, and the deposit counter Cd may be updated thereby. Further, in step S29, a predetermined value may be subtracted from the latest value of the oil-fat counter $Co_{(n-1)}$, and the oil-fat counter Co may be updated thereby. Further, the cleaning fluid may be consumed in accordance with the execution of the cleaning mode. Therefore, a predetermined value may be subtracted from a value of the amount of the cleaning fluid left in the cleaning fluid tank 41 in step S29.

Thereafter, in step S30, a determination may be made as to whether the value of the deposit counter Cd after the subtraction is smaller than a predetermined stop threshold Cd2. When a determination is made in step S30 that the value of the deposit counter Cd is equal to or greater than the stop threshold Cd2, such a determination may indicate a situation in which the cleaning of the deposit D is not completed. Therefore, the flow may return to step S28. The processes in respective steps S28 to S30 may be repeated to thereby continuously perform the cleaning mode until the value of the deposit counter Cd becomes smaller than the stop threshold Cd2. When a determination is made in step S30 that the value of the deposit counter Cd is lower than the stop threshold Cd2, and accordingly, a determination is made that the cleaning of the deposit D by the cleaning mode is completed, the flow may return to step S10. Further, the flow may proceed again from the step S10 to respective steps. Thus, the cleaning mode may be executed on an as-needed basis while the oil-fat counter Co, the deposit counter Cd, etc. are updated.

In contrast, when a determination is made in step S27 that the execution condition of the cleaning mode is not satisfied, the flow may proceed to step S31. In step S31, a determination may be made as to whether the amount of the cleaning fluid left in the cleaning fluid tank 41 is insufficient. When a determination is made in step S31 that the amount of the cleaning fluid left in the cleaning fluid tank 41 is insufficient, the flow may proceed to step S32. In step S32, an alarm lamp may be turned on that notifies an occupant of the insufficiency of the amount of the cleaning fluid left. Further, after turning on the alarm lamp, the flow may return to step S10 in order to prepare for the execution of the cleaning mode after supply of the cleaning fluid. The flow may proceed again from step S10 to the respective steps, and the oil-fat counter Co, the deposit counter Cd, etc. may be updated thereby When a determination is made in step S31 that the amount of the cleaning fluid left is not insufficient, the flow may return to step S10. The flow may proceed again from step S10 to the respective steps. The cleaning mode may be thereby executed on an as-needed basis while the oil-fat counter Co, the deposit counter Cd, etc. are updated. It is to be noted that, in one implementation, the amount of the cleaning fluid left in the cleaning fluid tank 41 may be calculated on the basis of an amount of injection performed by the cleaning injector 42. In another implementation, a level of a surface of the cleaning fluid left in the cleaning fluid tank 41 may be measured by a sensor or any other way, and the amount of the cleaning fluid left inside the cleaning fluid tank 41 may be calculated on the basis of the result of the measurement.

As described above, the oil-fat counter Co may be used when the value of the deposit counter Cd is calculated. The oil-fat counter Co may indicate the amount of the attached oil-fat that is the generation source of the deposit D. The deposit counter Cd may indicate the amount of the accumulated deposit D. This makes it possible to calculate the amount of the accumulated deposit D, taking into consideration a course of generation of the deposit D. Accordingly, it is possible to estimate the amount of the accumulated deposit D with high accuracy. Hence, it is possible to execute the cleaning mode at appropriate timing.

When the value of the oil-fat counter Co is equal to or greater than the addition threshold Co2, i.e., when the amount of the attached oil-fat that is the generation source is sufficient, the addition to the deposit counter Cd is permitted. In contrast, when the value of the oil-fat counter Co is smaller than the addition threshold Co2, i.e., when the amount of the attached oil-fat that is the generation source is small, the amount of the oil-fat to turn into the deposit D is small. Therefore, the addition to the deposit counter Cd is prohibited. This makes it possible to prevent, when the amount of the oil-fat to turn into the deposit D is small, the increase in the amount of the accumulated deposit D even when the intake port temperature Tp makes a transition in the temperature ranges T2 and T3. Hence, it is possible to estimate the amount of the accumulated deposit D with high accuracy. It is to be noted that the case where the value of the oil-fat counter Co is smaller than the addition threshold Co2 may correspond to the case where the determination is made in step S21 described above that the addition condition of the deposit counter Cd is not satisfied.

[Timing Chart]

Figure 6:
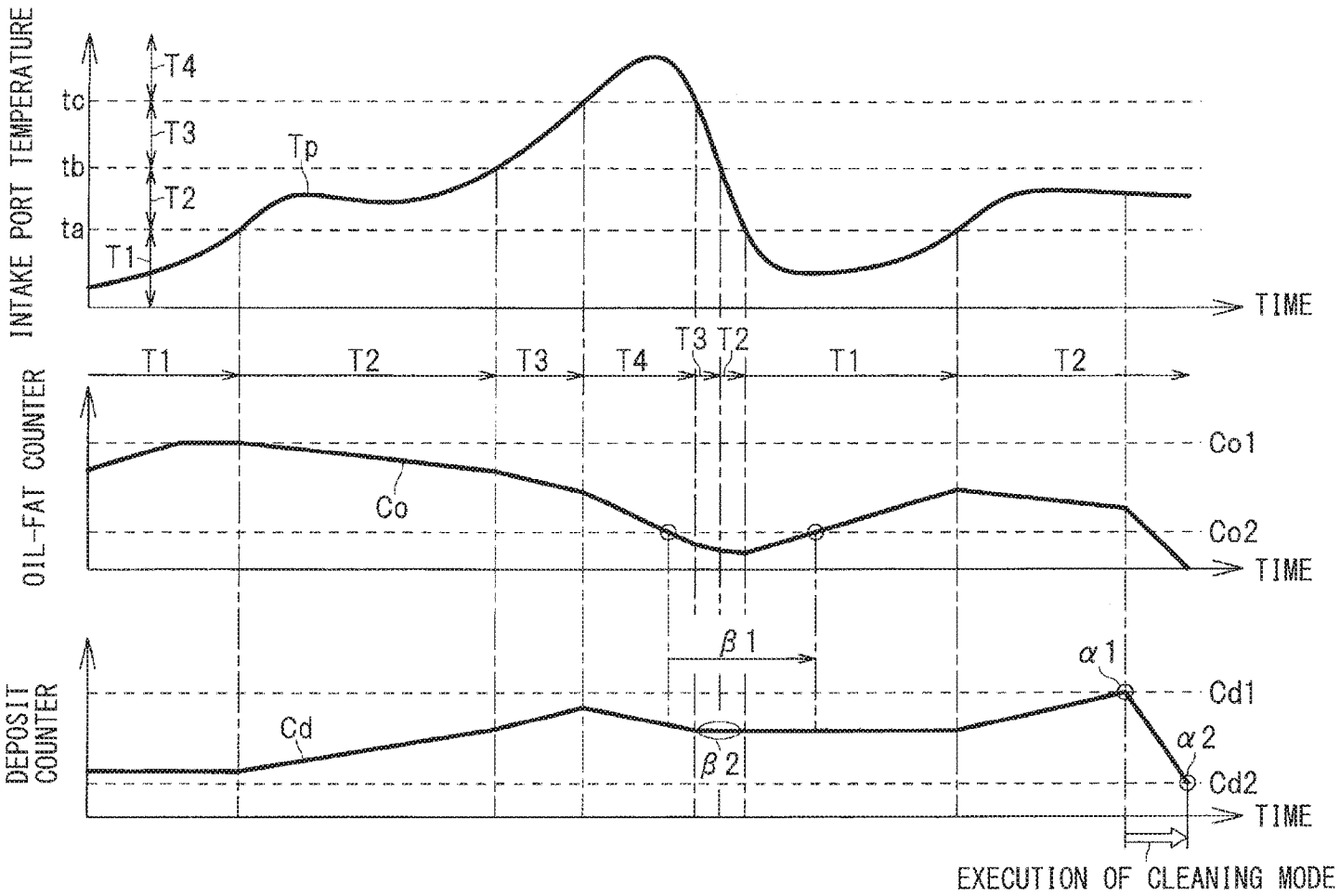
FIG. 6 is a timing chart illustrating an example of transition of an intake port temperature, an oil-fat counter, and a deposit counter.

A description is given next of transition in each of the intake port temperature Tp, the value of the oil-fat counter Co, and the value of the deposit counter Cd, with reference to a timing chart. FIG. 6 is a timing chart illustrating an example of transition of each of the intake port temperature Tp, the value of the oil-fat counter Co, and the value of the deposit counter Cd.

Referring to FIG. 6, when the intake port temperature Tp falls within the temperature range T1, the intake port temperature Tp is less likely to cause the oil-fat to turn into the deposit D. Therefore, the value of the oil-fat counter Co may increase in accordance with the elapse of time. It is to be noted that there is an upper limit for the amount of the oil-fat attached to the intake system 20. Therefore, the increase in the value of the oil-fat counter Co may be limited by an upper limit value Co1. Further, when the intake port temperature Tp falls within the temperature range T1, the oil-fat is less likely to turn into the deposit D. Therefore, the value of the deposit counter Cd may be kept constant without increasing or decreasing.

When the intake port temperature Tp falls within any of the temperature ranges T2 and T3, the intake port temperature Tp causes the oil-fat to turn into the deposit D. Therefore, the value of the oil-fat counter Co may decrease in accordance with the elapse of time, while the value of the deposit counter Cd may increase in accordance with the elapse of time. It is to be noted that, in a case where the intake port temperature Tp falls within the temperature range T3, a speed at which the value of the oil-fat counter Co decreases may be greater than that in a case where the intake port temperature Tp falls within the temperature range T2. Further, in the case where the intake port temperature Tp falls within the temperature range T3, a speed at which the value of the deposit counter Cd increases may be greater than that in the case where the intake port temperature Tp falls within the temperature range T2.

When the intake port temperature Tp falls within the temperature range T4, the intake port temperature Tp causes both the oil-fat and the deposit D to be burnt. Therefore, the value of the oil-fat counter Co may decrease in accordance with the elapse of time, while the value of the deposit counter Cd may decrease in accordance with the elapse of time.

Further, when the value of the deposit counter Cd reaches the execution threshold Cd1 at a point indicated by a symbol "α1", i.e., when the value of the deposit counter Cd is greater than the execution threshold Cd1, the cleaning mode may be started. The cleaning mode may cause the cleaning fluid to be injected into the intake port 16. The execution of the cleaning mode may be continued until the value of the deposit counter Cd becomes lower than the stop threshold Cd2 at a point indicated by a symbol "α2". The cleaning mode may be executed in such a manner on the basis of the value of the deposit counter Cd. It is thereby possible to prevent excessively-great amount of accumulation of the deposit D on the intake system 20, leading to normal functioning of the engine 11.

When the value of the oil-fat counter Co is lower than the addition threshold Co2 in a section indicated by a symbol "β1", i.e., when the amount of the attached oil-fat that is the generation source of the deposit D is small, the amount of the oil-fat to turn into the deposit D may be small. Therefore, the increase in the value of the deposit counter Cd may be prohibited. In other words, in the section indicated by β1, the value of the deposit counter Cd may be prevented from increasing as indicated by a symbol "β2", even when the intake port temperature Tp makes a transition in the temperature ranges T2 and T3. As a result, when the amount of the oil-fat that is the generation source of the deposit D is small, the amount of the accumulated deposit D may be prevented from increasing unnecessarily. Hence, it is possible to estimate the amount of the accumulated deposit D with high accuracy.

[Other Implementations]

Figure 7:
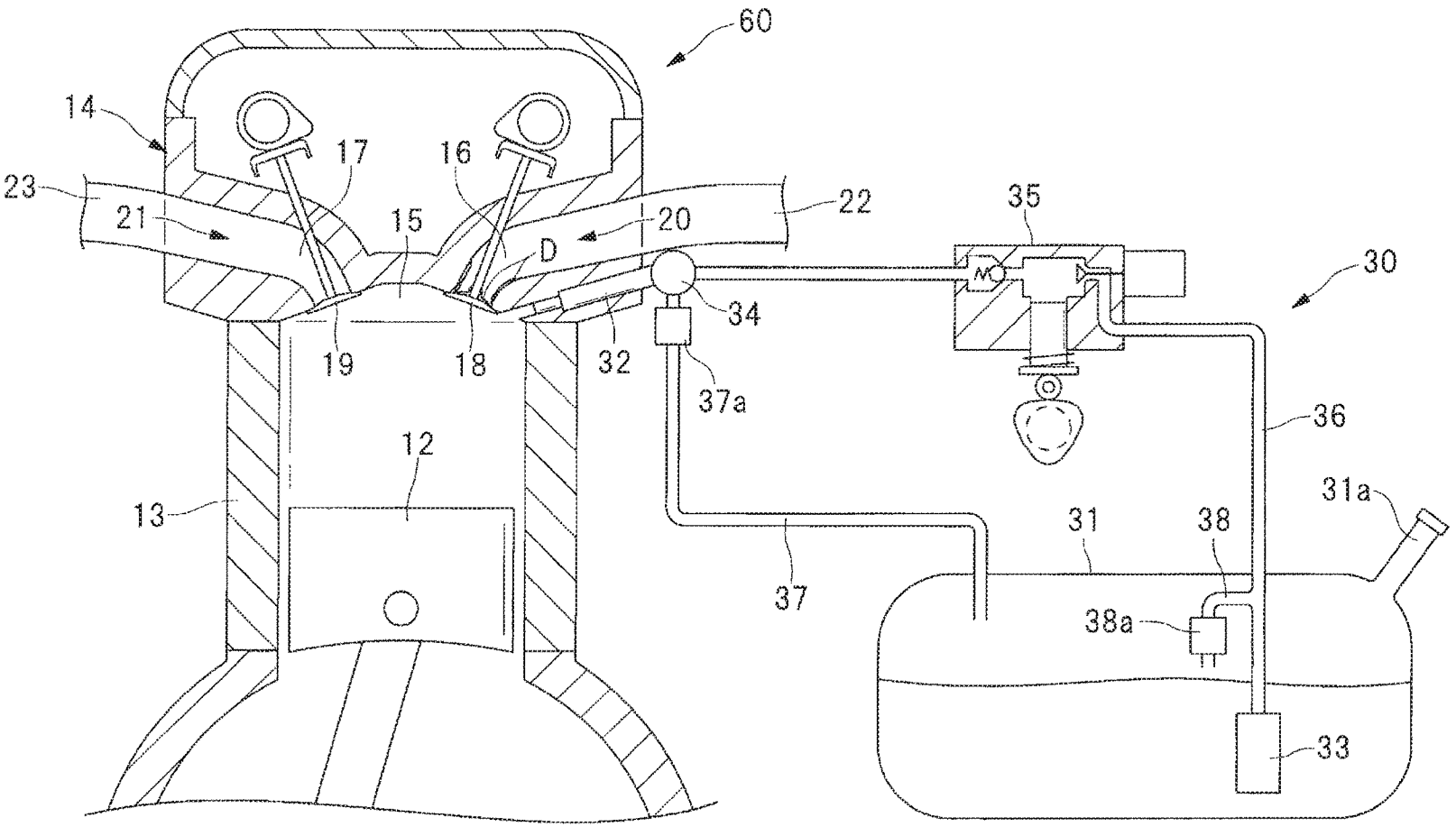
FIG. 7 illustrates an example of an outline of another engine to which the engine control apparatus is applied.

The engine 11 illustrated in FIG. 1 may include the cleaning system 40 that supplies the cleaning fluid to the intake system 20; however, the configuration of the engine is not limited thereto. The engine control apparatus 10 may be also effectively applicable to an engine 60 without the cleaning system 40. FIG. 7 illustrates an example of an outline of another engine, i.e., the engine 60, to which the engine control apparatus 10 is applied. It is to be noted that members and components illustrated in FIG. 7 that are similar to those illustrated in FIG. 1 are denoted with the same numerals and are not described further where appropriate.

Referring to FIG. 7, in the direct-injection engine 60 without the cleaning system 40, for example, the cleaning fluid directed to removing of the deposit D may be supplied into the fuel tank 31 from an inlet 31*a* every time traveling is performed for a predetermined distance, in order to remove the deposit D on the intake system 20. The cleaning fluid supplied into the fuel tank 31 in such a manner may be injected into the combustion chamber 15 from the fuel injector 32 together with the fuel.

Therefore, upon the removing of the deposit D by attaching the cleaning fluid to the components such as the intake port 16, the cleaning mode may be executed that increases the amount of the fuel-air mixture flowing back from the combustion chamber 15 to the intake port 16. In other words, the cleaning mode that increases the amount of the fuel-air mixture flowing back from the combustion chamber 15 to the intake port 16 may be executed, when the value of the deposit counter Cd is greater than the execution threshold Cd1, also for the direct-injection engine 60 without the cleaning system 40. This allows for execution of the cleaning mode at appropriate timing, which prevents excessively-great amount of accumulation of the deposit D. The cleaning mode that increases the amount of the fuel-air mixture flowing back from the combustion chamber 15 to the intake port 16 may be executed, for example but not limited to, by delaying closing timing of the intake valve 18, by advancing injection timing of the fuel, or by any other way. Further, when the cleaning fluid is supplied into the fuel tank 31 to execute the cleaning mode, one of the execution conditions of the cleaning mode in step S27 may be changed as follows. That is, in place of determining whether the amount of the cleaning fluid left in the cleaning fluid tank 41 is greater than the defined amount, a determination may be made as to whether the cleaning fluid is present in the fuel tank 31. Such a determination may be made on the basis of a factor such as the concentration of the cleaning fluid. In one implementation, when the concentration of the cleaning fluid is greater than a predetermined threshold, a determination may be made that the cleaning fluid is present in the fuel tank 31, leading to a determination that one of the execution conditions of the cleaning mode is satisfied.

Although some implementations of the technology have been described in the foregoing with reference to the accompanying drawings, the technology is by no means limited to the implementations described above. It should be appreciated that modifications and alterations may be made by persons skilled in the art without departing from the scope as defined by the appended claims. The technology is intended to include such modifications and alterations in so far as they fall within the scope of the appended claims or the equivalents thereof.

For example, the implementations described above refer to an example in which the intake port temperature Tp is calculated on the basis of the factors such as the revolutions of the engine 11 and the load on the engine 11; however, a method of calculating the intake port temperature Tp is not limited thereto. In an alternative implementation, the intake port temperature Tp may be detected with the use of a device such as a temperature sensor. Moreover, the implementations described above refer to an example in which the intake port temperature Tp is used as the temperature of the intake system 20; however, a temperature to be used as the temperature of the intake system 20 is not limited thereto. In an alternative implementation, the temperature of the intake valve 18 may be used as the temperature of the intake system 20.

FIG. 6 illustrates an example in which the addition threshold Co2 of the oil-fat counter Co is set to be greater than 0 (zero); however, the value of the addition threshold Co2 is not limited thereto. In an alternative implementation, the addition threshold Co2 of the oil-fat counter Co may be set to 0 (zero). Further, in the example illustrated in FIG. 6, the stop threshold Cd2 of the deposit counter Cd is set to be greater than 0 (zero); however, the value of the stop threshold Cd2 of the deposit counter Cd is not limited thereto. In an alternative implementation, the stop threshold Cd2 of the deposit counter Cd may be set to 0 (zero). Moreover, the implementations described above refer to an example in which the amount of the increase and the decrease in the deposit counter Cd per unit time is set for each of the temperature ranges T2, T3, and T4, independently of the magnitude of the value of the oil-fat counter Co; however, a way of setting the amount of the increase and the decrease in the deposit counter Cd per unit time is not limited thereto. In an alternative implementation, the amount of the increase and the decrease in the deposit counter Cd per unit time may be varied in accordance with the magnitude of the value of the oil-fat counter Co. Moreover, the illustrated engines 11 and 60 may each be the direct-injection engine; however, the type of the engine is not limited thereto. In an alternative implementation, a port-injection engine that injects the fuel into the intake port 16 may be employed. In another alternative implementation, an engine that injects the fuel into both the combustion chamber 15 and the intake port 16, i.e., an engine combining direct injection and port injection, may be employed.

The controller unit 50 illustrated in FIG. 1 is implementable by circuitry including at least one semiconductor integrated circuit such as at least one processor (e.g., a central processing unit (CPU)), at least one application specific integrated circuit (ASIC), and/or at least one field programmable gate array (FPGA). At least one processor is configurable, by reading instructions from at least one machine readable non-transitory tangible medium, to perform all or a part of functions of the controller unit 50. Such a medium may take many forms, including, but not limited to, any type of magnetic medium such as a hard disk, any type of optical medium such as a CD and a DVD, any type of semiconductor memory (i.e., semiconductor circuit) such as a volatile memory and a non-volatile memory. The volatile memory may include a DRAM and a SRAM, and the nonvolatile memory may include a ROM and a NVRAM. The ASIC is an integrated circuit (IC) customized to perform, and the FPGA is an integrated circuit designed to be configured after manufacturing in order to perform, all or a part of the functions of the controller unit 50 illustrated in FIG. 1.

The invention claimed is:

1. An engine control apparatus that executes a cleaning mode to clean a deposit generated in an intake system of an engine, the engine control apparatus comprising:

a generation source calculator configured to perform calculation of an attached generation source amount on a basis of a temperature of the intake system, the attached generation source amount being an amount of a generation source, of the deposit, attached to the intake system;

a deposit calculator configured to perform calculation of an attached deposit amount on a basis of the attached generation source amount and the temperature of the intake system, the attached deposit amount being an amount of the deposit attached to the intake system; and a mode controller configured to execute the cleaning mode, when the attached deposit amount is greater than an execution threshold, wherein the generation source calculator performs addition to the attached generation source amount when the temperature of the intake system is lower than a first temperature threshold, and performs subtraction from the attached generation source amount when the temperature of the intake system is higher than the first temperature threshold, the deposit calculator keeps the attached deposit amount constant without performing an addition or a subtraction when the temperature of the intake system is lower than the first temperature threshold, performs addition to the attached deposit amount when the temperature of the intake system is higher than the first temperature threshold and lower than a second temperature threshold that is higher than the first temperature threshold, and performs subtraction from the attached deposit amount when the temperature of the intake system is higher than the second temperature threshold, and the deposit calculator permits addition to the attached deposit amount when the attached generation source amount is greater than an addition threshold value, and prohibits the addition to the attached deposit amount when the attached generation source amount is smaller than the addition threshold value.

2. The engine control apparatus according to claim 1, wherein the intake system includes an intake port, and the temperature of the intake system comprises a temperature of the intake port.

3. An engine control apparatus that executes a cleaning mode to clean a deposit generated in an intake system of an engine, the engine control apparatus comprising circuitry configured to perform calculation of an attached generation source amount on a basis of a temperature of the intake system, the attached generation source amount being an amount of a generation source, of the deposit, attached to the intake system, perform calculation of an attached deposit amount on a basis of the attached generation source amount and the temperature of the intake system, the attached deposit amount being an amount of the deposit attached to the intake system, and execute the cleaning mode, when the attached deposit amount is greater than an execution threshold, wherein the circuitry performs addition to the attached generation source amount when the temperature of the intake system is lower than a first temperature threshold, and performs subtraction from the attached generation source amount when the temperature of the intake system is higher than the first temperature threshold, the circuitry keeps the attached deposit amount constant without performing an addition or a subtraction when the temperature of the intake system is lower than the first temperature threshold, performs addition to the attached deposit amount when the temperature of the intake system is higher than the first temperature threshold and lower than a second temperature threshold that is higher than the first temperature threshold, and performs subtraction from the attached deposit amount when the temperature of the intake system is higher than the second temperature threshold, and the circuitry permits addition to the attached deposit amount when the attached generation source amount is greater than an addition threshold value, and prohibits the addition to the attached deposit amount when the attached generation source amount is smaller than the addition threshold value.

* * * * *